US005305855A

United States Patent [19]

Rivera et al.

[11] Patent Number: 5,305,855

[45] Date of Patent: Apr. 26, 1994

[54] SEALED ELEVATOR CAB ENTRANCE ASSEMBLY

[75] Inventors: James A. Rivera, Bristol, Conn.; Christian Tonna, Sao Paulo, Brazil

[73] Assignee: Otis Elevator Company, Farmington, Conn.

[21] Appl. No.: 37,138

[22] Filed: Mar. 25, 1993

[51] Int. Cl.[5] ..... B66B 13/00

[52] U.S. Cl. ..... 187/56; 49/120; 49/483.1

[58] Field of Search ..... 187/56, 51, 1 R; 49/120, 116, 475.1, 428, 483.1

[56] References Cited

U.S. PATENT DOCUMENTS

| | | | |
|---|---|---|---|
| 2,694,840 | 11/1954 | Smith | 49/428 |
| 4,607,457 | 8/1986 | Shewchuk | 49/475.1 |
| 5,083,639 | 1/1992 | Kappeler | 187/56 |

FOREIGN PATENT DOCUMENTS

| | | | |
|---|---|---|---|
| 412984 | 1/1992 | Japan | 187/56 |
| 199052 | 10/1965 | Sweden | 49/475.1 |

*Primary Examiner*—Kenneth W. Noland

[57] ABSTRACT

The entrance to an elevator cab is provided with wedge gaskets both above and below the cab door opening. The upper gasket is mounted on the door opening header, and the lower gasket is mounted in the door sill. Gasket-engaging brackets are mounted on the top and bottom of each door to snugly engage the gaskets when the cab doors are closed. The closed cab is substantially sealed against penetration by hoistway air so as to provide a quieter smoother ride, especially at high operating speeds. The seal is not established until the doors are completely closed.

7 Claims, 3 Drawing Sheets

SEALED ELEVATOR CAB ENTRANCE ASSEMBLY

TECHNICAL FIELD

This invention relates to an elevator cab structure and more particularly, to an elevator cab structure having a sealed door system which, when closed, seals the interior of the cab from the hoistway environment.

BACKGROUND ART

Structures for sealing elevator hoistway doors from the landings in buildings have been proposed. The reason for sealing the hoistways from the remainder of the building is to prevent the hoistways from becoming conduits for smoke from one building floor to another in the event of a fire in the building. These systems have vertically reciprocating sealing panels on the upper and lower portions of the door frame. These panels are reciprocated vertically as a result of contact with the landing doors as the latter are opened and closed. U.S. Pat. Nos. 3,734,238, granted May 22, 1973 to A.V. Secresty, et al; and U.S. Pat. No. 4,735,293, granted Apr. 5, 1988 to L.R. Everhart, et al. are representative of such elevator systems. These systems are fine for the limited purpose for which they are intended.

With modern-day elevator systems operating at ever increasing speeds, chiefly due to the extremely tall buildings being built, the problem of hoistway cab-induced air turbulence adversely affecting cab ride and passenger comfort has increased. The higher the cab speed, the more noise and buffeting of the cab will occur. With present cab door systems, at high cab speeds air drafts inside of the cab can occur through the cab doors. The net result is a less than ideal ride from the passenger's viewpoint. The ride quality in such high speed elevators could be enhanced by the provision of a cab door system which effectively seals the interior of the cab from the hoistway when the cab doors are closed. Ideally, such a system would be susceptible to use in original equipment and would be factory installed as original equipment; and could also be installed as retrofit equipment in existing elevator systems in the field.

DISCLOSURE OF THE INVENTION

This invention is directed toward an elevator cab assembly having a door system which effectively seals the interior of the cab from the hoistway environment. The system provides a seal with no auxiliary moving parts, except for the doors and the door actuator. The doors are mounted on tracks which are secured to the cab entrance header. A tapered wedge-shaped gasket is mounted on the cab door opening header and is engaged by wedge brackets mounted on the doors. The joint created by the wedge gasket and wedge brackets will effectively hermetically seal the top of the cab door opening when the cab doors are closed. A wedge gasket is also mounted in the cab door sill and complementary wedge brackets are mounted on the lower edge of each door. When the doors are closed, the lower wedge gasket and wedge brackets seal the lower edge of the door opening. The system of this invention does not require any auxiliary moving parts, other than the door or doors, and the door actuator.

It is therefore an object of this invention to provide an elevator cab door assembly which will effectively seal the cab interior from the hoistway when the cab doors are closed.

It is a further object of this invention to provide a cab door assembly of the character described which operates without moving parts save for the door or doors and the door actuator.

It is an additional object of this invention to provide a cab door assembly of the character described which can be retrofitted onto existing equipment in the field, or can be included as original factory-installed equipment.

These and other objects and advantages of the invention will become more readily apparent from the following detailed description of a preferred embodiment of the invention when taken in conjunction with the accompanying drawings, in which:

BEST MODE FOR CARRYING OUT THE INVENTION

Figure 1:
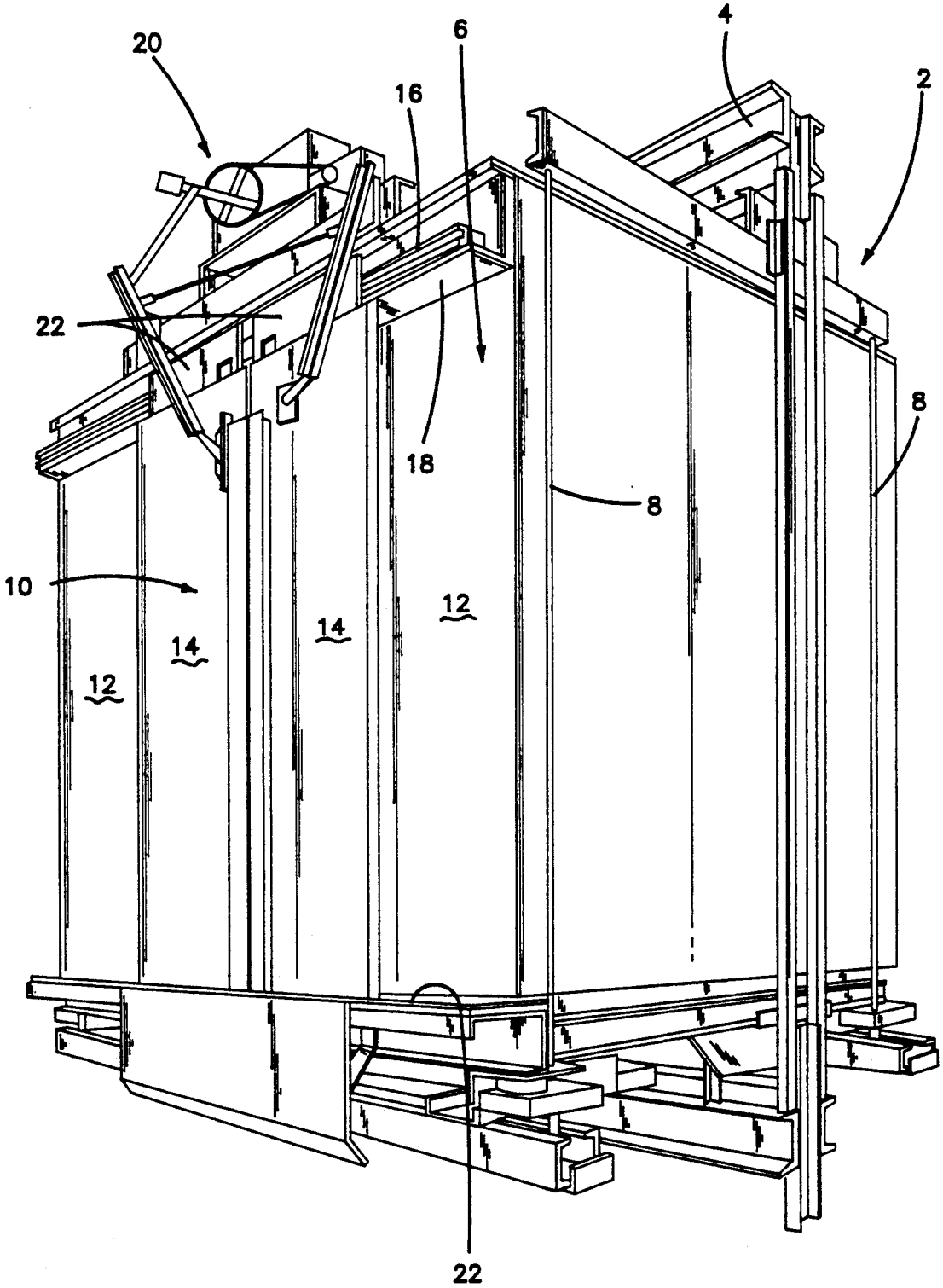
FIG. 1 is a perspective view of a typical high speed traction elevator cab assembly.

Referring now to the drawings, there is shown in FIG. 1 a typical high speed elevator cab assembly denoted generally by the numeral 2. The cab assembly 2 includes a frame 4 to which the hoist ropes (not shown) are connected. The cab 6 is mounted in the frame 4, and will typically be isolated to some extent from vibrations which occur in the frame 4. In the assembly shown, the cab 6 is suspended on the frame 4 by means of pendulum rods 8. The cab entrance wall is denoted generally by the numeral 10 and includes a pair of spaced apart wall panels 12 which flank the passenger opening into the cab 6. A pair of cab doors 14 are reciprocally slidably disposed on tracks 16 mounted on the cab entrance overhead panel 18. The doors 14 are reciprocated between open and closed positions by a conventional door operating system 20 mounted on the cab 6. The upper edges of the doors 14 overlap the overhead 18, and the lower edges of the doors 14 ride on the cab door sill 22, as shown most clearly in FIGS. 3 and 4.

Figure 2:
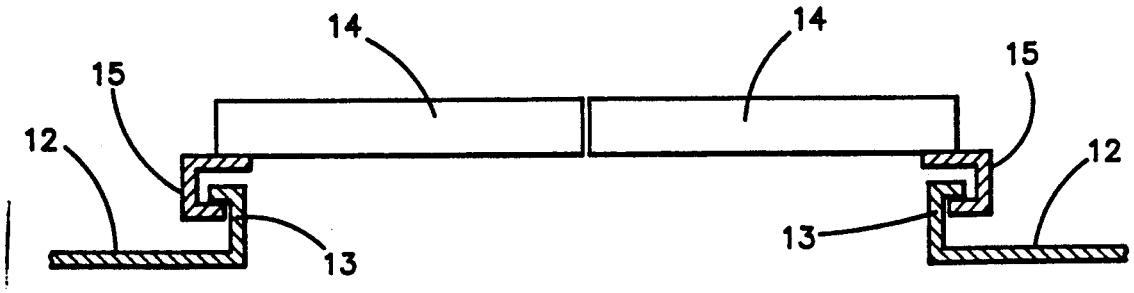
FIG. 2 is a plan view of the cab entrance area showing the cab doors in their closed condition.
Figure 3:
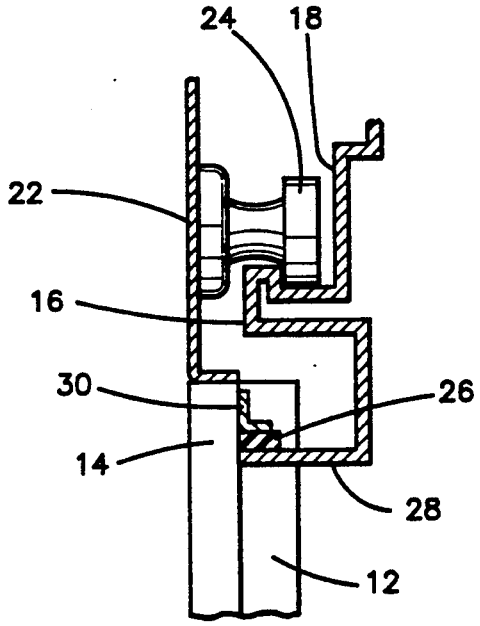
FIG. 3 is a fragmented sectional view of the door roller/door track assembly in the cab door overhead.
Figure 4:
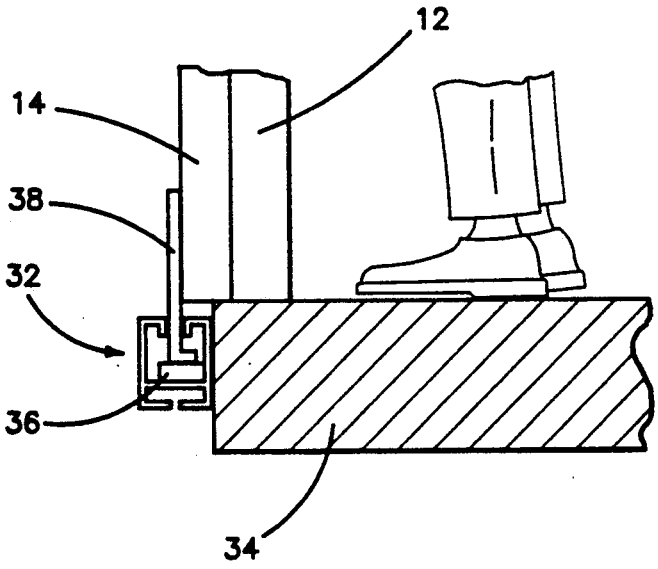
FIG. 4 is a view similar to FIG. 3 but showing the cab door sill area.

Referring now to FIGS. 2–4, details of the door mount and seal components of the invention are shown. FIG. 2 shows the side labyrinth seals on the doors 14 and wall panels 12. Each side wall panel 12 has a generally J-shaped inner edge 13, and each of the doors 14 has a generally J-shaped outer edge 15. When the doors 14 are closed, as shown in FIG. 2, the edges 13 and 15 nest so as to form a labyrinth seal at the Vertical outer edges of the doors 14. This seal retards hoistway air from entering the cab 6 through the outer door jams when the doors 14 are closed.

FIGS. 3 and 4 illustrate details of the upper and lower edges of the doors and the cab door frame, and how the hermetic seal is made. As seen in FIG. 3, the cab door opening header panel 18 and the track 16 formed thereon are shown. The doors 14 also include header panels 22 which extend above the upper end of the doors 14, and which overlie the cab door opening header panel 18. The door header panels 22 have rollers 24 mounted thereon which rollers ride over the tracks 16 as the doors 14 are opened and closed. A wedge-shaped gasket 26 is mounted on a lowermost flange 28 on the door opening header panel 18, and a wedge bracket 30 is mounted on each of the doors 14 for engagement with the wedge gasket 26, as will be more clearly explained hereinafter.

The sill portion of the door mount is shown in FIG. 4. A door sill 32 is mounted on the floor panel 34 of the cab. A wedge-shaped gasket 36 is mounted inside of the door sill 32, and a lower wedge bracket 38 is mounted on the lower edge of each of the doors 14. The wedge brackets 38 extend into the interior of the sill 32, and engage the wedge gasket 36, as will be more clearly explained hereinafter.

Figure 5:
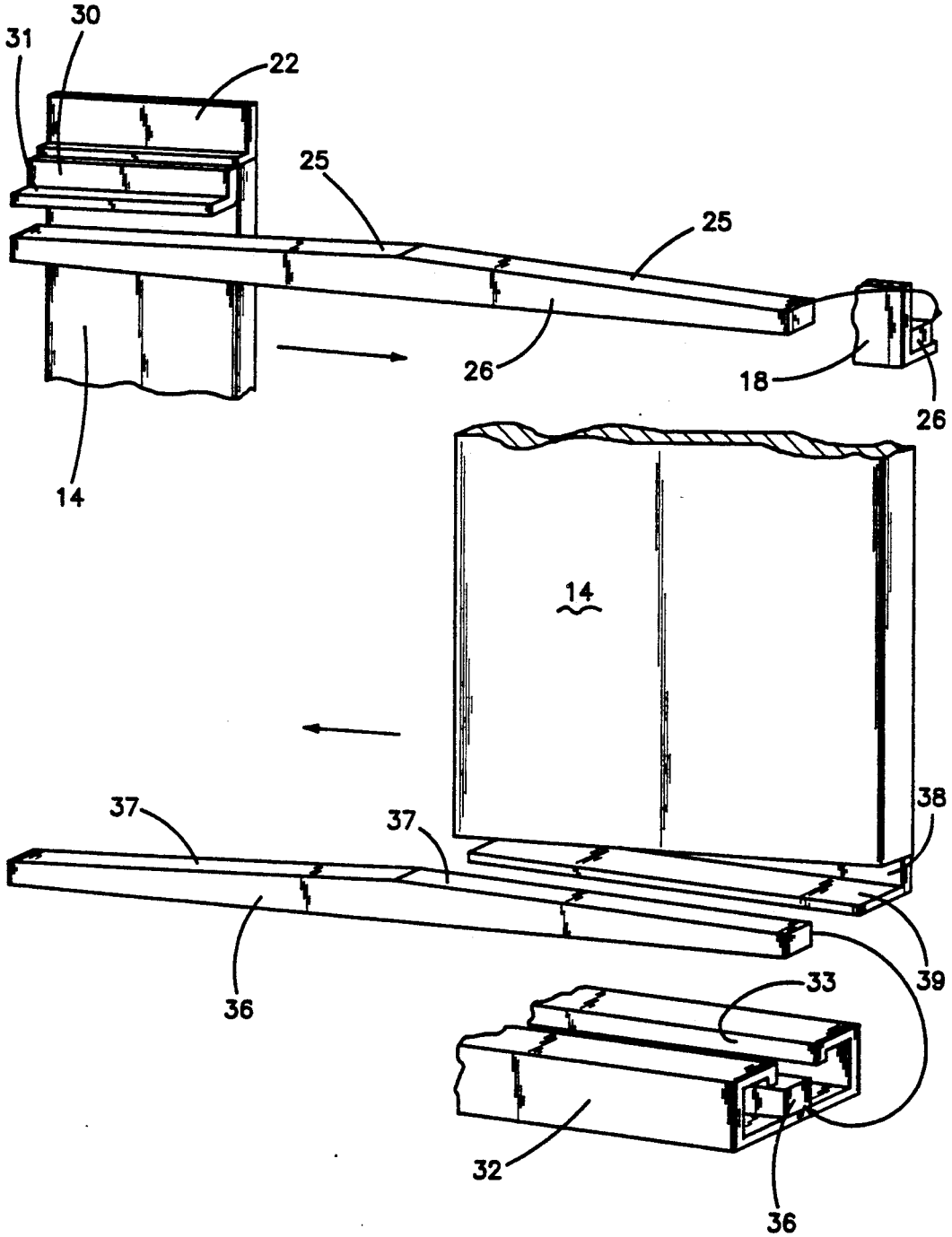
FIG. 5 is a fragmented exploded perspective view of the door overhead and sill areas of the cab as seen from the interior of the cab.

Referring now to FIG. 5, details of the upper and lower wedge gasket and wedge bracket mounts are shown. As shown in FIG. 4, the cab sill 32 is mounted on a front vertical surface of the cab floor 34. The sill wedge gasket 36 is mounted inside of the sill 32. The gasket 36 includes opposed centrally upwardly tapering top surfaces 37. The lower door wedge brackets 38 are mounted on the bottom of the doors 14, and extend into the sill 32 through a gap 33 in the upper surface thereof. The brackets 38 have horizontal flanges 39 which taper upwardly and inwardly in conformance with the taper on the gasket surfaces 37. The header wedge gasket 26 also has top inwardly and upwardly tapering surfaces 25, and is mounted on the cab door opening header panel 18. The upper wedge brackets 30 have horizontal tapered flanges 31 which have taper angles which conform to the taper of the header wedge gasket surfaces 25. When the doors 14 are open, the bracket flanges 31 and 39 are spaced apart from the wedge surfaces 25 and 37, respectively, and the bracket and wedge surfaces will be essentially parallel to each other. As the doors 14 close, the surfaces 25, 31 and 37, 39 move toward each other, but without touching until the doors have completely closed. At that time, and substantially only at that time, is the cab interior sealed from the hoistway.

It will be readily appreciated that the door system of this invention operates with substantially the same degree of friction and noise as an identical door system without the cab-sealing components. The sealing modifications can be added to an existent elevator system in the field, and, of course, can be installed as original factory equipment. The invention is particularly useful in high speed, high rise elevator systems, and can significantly increase ride stability and passenger comfort at higher cab speeds. The wedge brackets are preferably formed from a harder, durable material such as a rigid plastic, aluminum, steel, or the like. The wedge gaskets are preferably made from a softer material such as a sponge tape, rubber, or other elastomeric plastics. The seal system can also be used on landing entrances to prevent escape of hoistway air or smoke into the landing floors.

Since many changes and variations of the disclosed embodiment of the invention may be made without departing from the inventive concept, it is not intended to limit the invention otherwise than as required by the appended claims.

What is claimed is:

1. In combination with an elevator cab structure, a passenger door assembly comprising:

a) at least one elevator door translationally reciprocally movably mounted on said cab structure adjacent to a cab door opening therein, said door being movable between a door-open position and a door-closed position;

b) a track mounted on said cab structure and engaged by said door, said track providing a guide for said translational door movement;

c) upper and lower horizontally extending first seal means mounted adjacent to upper and lower edges respectively of said cab door opening, said lower first seal means being mounted in a sill portion of said cab door opening;

d) upper and lower second seal means mounted adjacent to said upper and lower edges respectively of said door; and e) each of said first seal means having first vertically inclined sealing surfaces thereon, and each of said second seal means having vertically inclined sealing surfaces thereon, said sealing surfaces of said second seal means being laterally offset from said sealing surfaces of said first seal means when said door is in said door-open position, and said sealing surfaces of said second seal means being disposed in substantially hermetically sealing engagement with said sealing surfaces of said first seal means when said door is in said door-closed position.

2. The combination of claim 1 wherein said lower second seal means is mounted on an edge of said door which nests in said sill portion of said cab door opening.

3. The combination of claim 1 wherein there are two separate cab doors which are reciprocally slidable on said track in opposite directions relative to each other to open and close said door opening; each of said doors having said seal means mounted thereon with respective said sealing surfaces of said second seal means; and wherein said first seal means comprises a gasket mounted above said door opening, said gasket having oppositely extending tapered first sealing surfaces, said gasket being mounted adjacent to said door opening between said doors, and said oppositely extending tapered first sealing surfaces tapering upwardly and outwardly toward opposite vertical sides of said door opening.

4. The combination of claim 3 wherein each of said cab doors comprises upper and lower edge sealing brackets; and wherein there are upper and lower complementary sealing gaskets mounted on said cab above and below said door opening between said doors.

5. In combination with an elevator cab structure, a passenger door assembly comprising:

a) a pair of separate cab doors translationally reciprocally movably mounted on said cab structure adjacent to a door opening therein, said doors being movable in opposite directions relative to each other between a door-open position and a door-closed position;

b) a track mounted on said cab structure for providing a guide for said translational door movement;

c) a first horizontally extending seal means comprising a gasket mounted above said door opening on said cab structure adjacent to said door opening, said gasket having oppositely extending tapered first sealing surfaces, said gasket being mounted adjacent to said door opening between said doors, and said oppositely extending tapered first sealing surfaces tapering upwardly and outwardly toward opposite vertical sides of said door opening; and d) second horizontally extending seal means mounted on each of said cab doors adjacent to horizontal edges thereof, said second seal means having second vertically inclined sealing surfaces thereon, said second sealing surfaces being laterally offset from said first sealing surfaces when said doors are in said door-open position, and said second sealing surface being disposed in substantially hermetically sealing engagement with said first sealing surfaces when said doors are in said door-closed position.

6. The combination of claim 5 wherein each of said cab doors comprises upper and lower edge sealing brackets; and wherein there are upper and lower complementary sealing gaskets mounted on said cab above and below said door opening between said doors.

7. An elevator system comprising:

a) a passenger cab including an entrance opening formed in one wall thereof;

b) a track mounted on said cab above said entrance opening;

c) a sealing gasket mounted on said cab adjacent to said track, said gasket including opposed gasket sealing surfaces on one side thereof which taper toward opposite sides of said gasket;

d) a pair of doors mounted on said track for sliding movement thereon; said doors being movable between a spaced apart entrance-open position, and an abutting entrance-closed position;

e) sealing brackets mounted on each door opposite to said sealing gasket, each sealing bracket having bracket sealing surfaces thereon which are positioned to abut a complementary one of said gasket sealing surfaces when said doors are in said entrance-closed position whereby at least one horizontal edge of said entrance opening is sealed against passage of hoistway air; and f) a sill means at lower horizontal edge of said entrance opening; a sill gasket mounted on said sill means, said sill gasket comprising oppositely tapered sill gasket sealing surfaces thereon; and sill brackets mounted on said doors, said sill brackets each having sill bracket sealing surfaces thereon translationally aligned with complementary ones of said sill gasket sealing surfaces whereby said sill gasket and said sill brackets will combine to seal said entrance sill against hoistway air when said doors are in said entrance-closed position.

* * * * *